United States Patent [19]

Jordan

[11] 4,000,996

[45] Jan. 4, 1977

[54] REFRIGERATING PACKAGE

[75] Inventor: George Jordan, Fairfield, Conn.

[73] Assignee: Hospital Marketing Services Co., Inc., Fairfield, Conn.

[22] Filed: Nov. 7, 1975

[21] Appl. No.: 630,042

[52] U.S. Cl. ..... 62/4

[51] Int. Cl.[2] ..... F25D 5/00

[58] Field of Search ..... 62/4

[56] References Cited

UNITED STATES PATENTS

| | | | |
|---|---|---|---|
| 2,157,169 | 5/1939 | Foster | 62/4 |
| 3,763,622 | 10/1973 | Stanley, Jr. | 62/4 |
| 3,804,077 | 4/1974 | Williams | 62/4 |
| 3,874,504 | 4/1975 | Verakas | 62/4 |
| 3,887,346 | 6/1975 | Erdman | 62/4 |

*Primary Examiner*—Jack Sofer

*Attorney, Agent, or Firm*—Peter L. Berger

[57] ABSTRACT

A refrigerating package is disclosed which comprises a multicompartment gussetted design in which the gusset is formed of a folded in or pleated section, with liquid being placed therein. The gussetted compartment is folded into another compartment and is sealed, the other compartment receiving a refrigerating chemical, the opening of the other compartment being sealed after the refrigerating chemicals are loaded therein. By direct application of pressure to the gussetted compartment, a rupture takes place allowing the liquid container therein to mix with the refrigerating chemical thus producing an endothermic or exothermic reaction, as desired.

4 Claims, 3 Drawing Figures

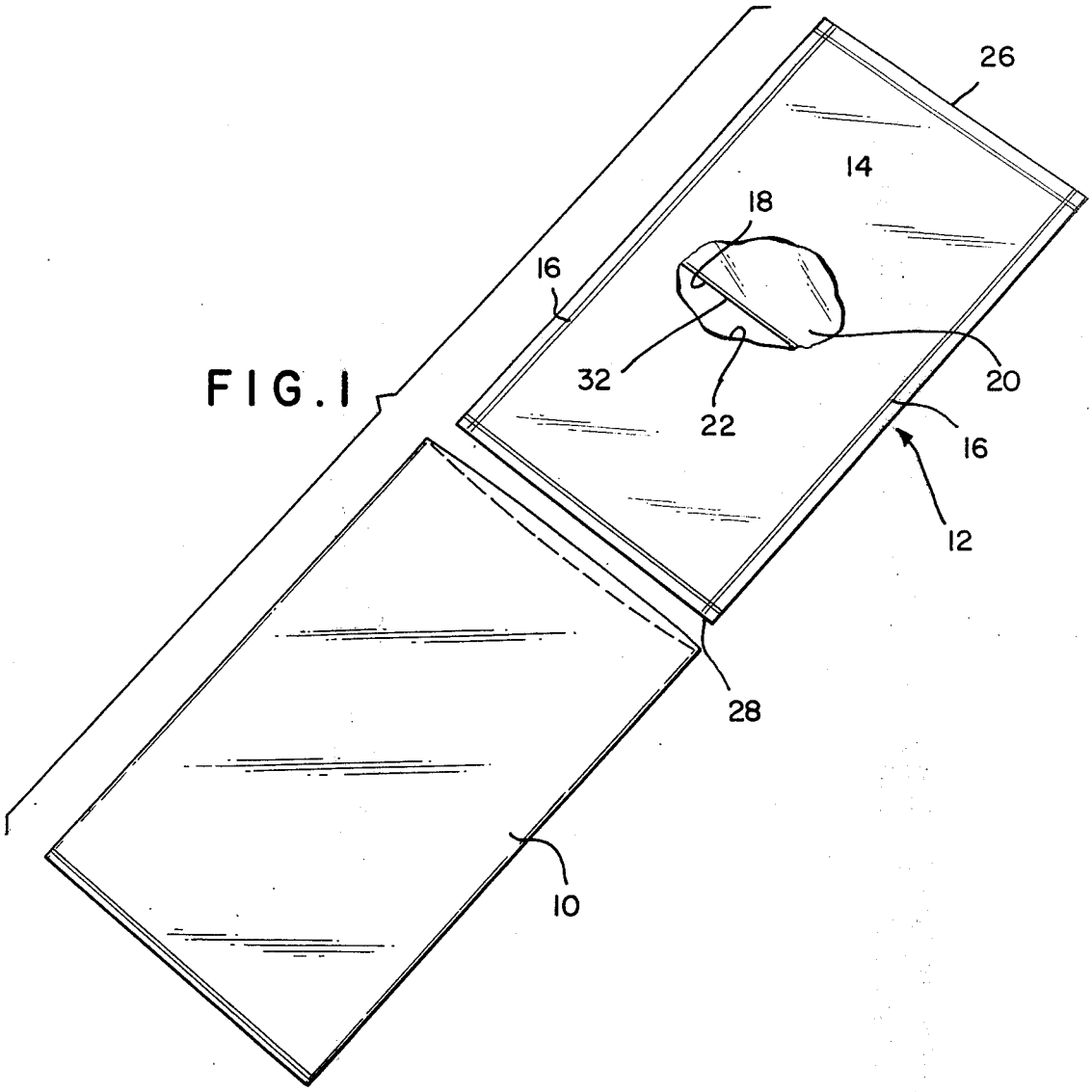
FIG. 1
FIG. 2
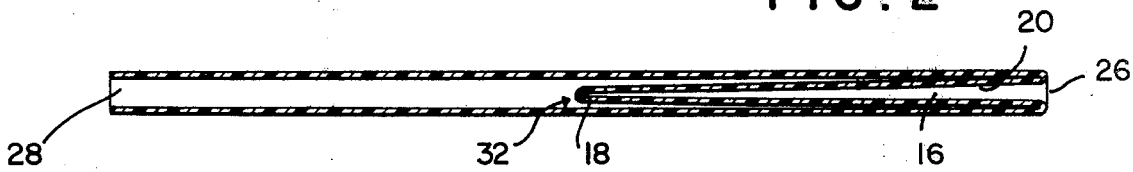
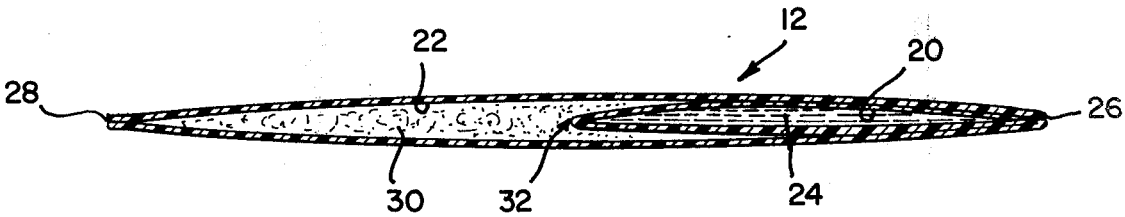
FIG. 3

REFRIGERATING PACKAGE

BACKGROUND OF THE INVENTION

This invention relates to a refrigerating package, and more particularly, to a refrigerating package which is portable in construction and easy to utilize.

Refrigerating packages for cooling or heating are generally well known in which refrigerating chemicals which produce an endothermic or exothermic reaction, respectively, are intermixed with liquid, such as water. Generally, such packages comprise inner and outer bags, with the inner bag containing water while the outer bag contains the refrigerating chemical. The direct pressure is applied to the outer bag causing a rupture of the inner bag and this two bag construction enables portable use to be provided.

The cost of such a two bag construction as well as the method of assembly is somewhat cumbersome and problematic, and improvements over that construction is sought to be made, such as providing a multicompartment of refrigerating package made of a single sheet of material.

An object of this invention is to provide an improved refrigerating package formed of a multicompartment design.

Another object of this invention is to provide such a multicompartment refrigerating package in which the possibility of an inadvertent rupture is minimized.

Yet another object of this invention is to provide such a construction which is simple to use, easy to assemble and effective in operation.

Other objects, advantages and features of this invention will become more apparent from the following description.

SUMMARY OF THE INVENTION

In accordance with the principles of this invention, the above objects are accomplished by providing a refrigerating package which is formed of a gussetted compartment folded within an outer compartment, the gussetted compartment receiving a liquid. The outer compartment is then loaded with a refrigerating chemical and both compartments are sealed. With pressure applied to the gussetted compartment, a rupture takes place allowing the liquid and refrigerating chemical to intermix causing the desired heating or cooling effect.

The refrigerating package can be housed within an outer envelope, the outer envelope housing the entire refrigerating package, as desired.

BRIEF DESCRIPTION OF THE DRAWINGS

FIG. 1 is an exploded view of an inner refrigerating package being housed within an outer envelope;

FIG. 2 is a sectional view of the inner refrigerating package showing the gussetted compartment folded into the outer compartment; and FIG. 3 is a sectional view similar to FIG. 2 showing the gussetted compartment being filled with the liquid and the outer compartment being filled with a refrigerating chemical. DETAILED DESCRIPTION Referring to the drawings, there is shown in FIG. 1 an exploded view of an outer envelope 10 into which is placed the inner refrigerating package 12. The inner refrigerating package is formed generally of a cylindrical sheet of material 14 being sealed lengthwise as at 16, with one end 18 of the cylindrical tubular material folded inwardly to form a gusset or pleat compartment 20 and sealed. Thus, there is a double wall thickness provided for the gussetted compartment 20 as illustrated in FIGS. 2 and 3. The gusset compartment 20 is folded into an outer compartment 22 and in operation, a liquid 24 is loaded within gussetted compartment 20 with the open mouth portion 26 being sealed after the liquid is loaded therein. The open mouth portion 28 of the outer compartment enables a refrigerating chemical 30 to be placed therein, the refrigerating chemical generally surrounding the gussetted compartment 20. The outer compartment 22 is then sealed at the open mouth portion 28 and a closed sealed refrigerating package is thus formed.

With pressure directly applied to the gussetted or pleated compartment 20, a rupture takes place allowing the liquid to mix with the refrigerating chemical thus producing the desired heating or cooling effect.

As a further feature of this invention, a weakened section or area 32 is formed along the seal 18 so as to enhance the rupturing of the gusset compartment with pressure being applied thereto. The weakening may be effected by such techniques as employing a Tower Tear or a diamond heat seal at the very outer edge of the gusset.

The materials used to form the refrigerating package of my invention generally are film or sheet plastic material having a thickness no greater than 6 mils.

The outer envelope 10 may be formed of any type of material, such as a woven or non woven material plastic or foam as desired. The properties of the outer envelope such as thermal insulation, absorption of condensate, additional wall strength, cosmetics and other considerations will dictate the choice of such materials.

It can be seen by reference to FIGS. 2 and 3, that the ability to form the multicompartment refrigerating package as well as fill and seal the same is facilitated by the present invention.

I claim:

1. A refrigerating package of a multicompartment construction formed of a single sheet of flexible plastic material, said single sheet of material being folded along the middle and sealed along the two coincidental edges opposite the fold to form a cylindrical plastic tube, one end of said tube being sealed closed, said sealed closed end being folded inwardly into said tube to form a compartmental gusset chamber having an open mouth, said gusset compartment being formed within the resulting outer compartment, a liquid placed within said gusset compartment, said gusset compartment being sealed at its said open mouth, a refrigerating chemical supplied to said outer compartment through its open end thereof, said outer compartment being sealed at said open end to enclose said refrigerating chemical and form said multicompartmented package, said gusset compartment being ruptured by pressure applied thereto enabling said liquid and refrigerating chemical to mix.

2. A refrigerating package as set forth in claim 1, wherein said plastic sheet is no more than 6 mils in thickness.

3. A refrigerating package as set forth in claim 1, further comprising an outer bag housing said refrigerating package, said outer bag being in direct contact with said refrigerating package to permit pressure to be applied to said gusset compartment for said bursting to occur.

4. A refrigerating package as set forth in claim 1, wherein said gusset compartment comprises a weakened portion enhancing the rupturing of said gusset compartment.

* * * * *